US010905289B2

(12) United States Patent
Augustus, Sr.

(10) Patent No.: US 10,905,289 B2
(45) Date of Patent: Feb. 2, 2021

(54) BATHTUB INSTALLATION AIDE

(71) Applicant: Ray Augustus, Sr., Alice, TX (US)

(72) Inventor: Ray Augustus, Sr., Alice, TX (US)

( * ) Notice: Subject to any disclaimer, the term of this patent is extended or adjusted under 35 U.S.C. 154(b) by 0 days.

(21) Appl. No.: 16/243,018

(22) Filed: Jan. 8, 2019

(65) Prior Publication Data

US 2020/0214507 A1 Jul. 9, 2020

(51) Int. Cl.
*A47K 3/02* (2006.01)
*E03C 1/04* (2006.01)

(52) U.S. Cl.
CPC . *A47K 3/02* (2013.01); *E03C 1/04* (2013.01)

(58) Field of Classification Search
CPC ..... A47K 3/02
USPC ..... 4/595
See application file for complete search history.

(56) References Cited

U.S. PATENT DOCUMENTS 3,955,221 A * 5/1976 Finch ..... A47K 3/006 4/539
4,067,071 A * 1/1978 Altman ..... A47K 3/008 4/546
4,337,540 A * 7/1982 Lindeman ..... A47K 3/006 4/546
4,553,276 A * 11/1985 Paradis ..... A47K 3/284 4/596
4,756,445 A * 7/1988 Agee, Sr. ..... B65F 1/08 220/23.89
5,619,760 A * 4/1997 Wang ..... A47K 3/04 4/584
6,003,166 A * 12/1999 Hald ..... A61H 33/6026 137/563
6,085,367 A * 7/2000 Guiste ..... A47K 3/002 4/546
6,101,642 A * 8/2000 Auten ..... A47K 3/002 4/546
6,401,983 B1 * 6/2002 McDonald ..... B60P 1/56 220/1.5
D527,083 S * 8/2006 Lebrun ..... D23/280.1
7,559,096 B2 * 7/2009 Zolotnik ..... A45D 29/00 4/622
7,926,126 B2 * 4/2011 Whitley ..... A47K 3/022 4/555
8,387,175 B2 * 3/2013 Vinokur ..... A61H 33/025 4/541.4
8,453,275 B2 * 6/2013 May ..... A61H 33/005 4/507
8,646,120 B2 * 2/2014 Schueler ..... A47K 3/04 4/584

(Continued)

*Primary Examiner* — Lori L Baker
(74) *Attorney, Agent, or Firm* — Michael L. Greenberg, Esq.; Greenberg & Lieberman, LLC

(57) ABSTRACT

A bathtub installation aide apparatus. The apparatus exhibits a box-shape, which is configured to act as a placeholder at a drain point. The apparatus is equipped with a drain trough, and facilitates in the creation of empty space around a tub drain during ultimate installation of a bathtub. The apparatus removes the need to use cardboard and/or dirt/sand in the molding and construction of the bathtub and foundation. A leak detector unit is present to alert when the presence of a leak is detected after a set period of time has elapsed. A sensor is configured to relay the presence of water to the leak detector unit. A bottom of the apparatus is equipped with tiers or steps to funnel water towards the drain, even in the event of a leak.

5 Claims, 4 Drawing Sheets

(56) References Cited

U.S. PATENT DOCUMENTS

| | | | | |
|---|---|---|---|---|
| 8,973,177 | B2 * | 3/2015 | Bates | A47K 3/02 4/584 |
| 9,186,023 | B2 * | 11/2015 | Brunelle | A47K 3/00 |
| D847,375 | S * | 4/2019 | Trudell | D25/14 |
| 10,442,614 | B2 * | 10/2019 | Lucas | B65D 90/022 |
| 2006/0137087 | A1 * | 6/2006 | Carreau | A61H 33/0087 4/541.1 |
| 2006/0230513 | A1 * | 10/2006 | Cunerty | A47K 3/001 4/498 |
| 2006/0236450 | A1 * | 10/2006 | Shanks | A47K 3/001 4/580 |
| 2008/0083063 | A1 * | 4/2008 | Libit | A47K 3/006 4/571.1 |
| 2009/0007326 | A1 * | 1/2009 | Bozic | A47K 3/02 4/595 |

* cited by examiner

BATHTUB INSTALLATION AIDE

FIELD OF THE PRESENT INVENTION

The present invention relates in general to plumbing methods and components, and more specifically relates to an apparatus, and method of use thereof, configured to facilitate installation of a bathtub within a bathroom.

BACKGROUND OF THE PRESENT INVENTION

In the building of a new house, for example, it is standard practice to install a bathtub at approximately the time of completion of the rough framing and flooring of the bathroom, and prior to the installation of the finished wall and floor surfaces. This permits the tub to be "built-in" to the wall. While such a procedure is highly desirable from an aesthetic point of view, it is undesirable from certain other standpoints, in view of the fact that these finishing operations involve the use of plaster, lath, paint, trim, tile, among other materials, by plasters, carpenters, and other workmen.

Currently, to install a plumbing drain for tubs on the first floor, a drain riser must be boxed out so that a void can be created in concrete around this riser so that when cement is poured, a plumber can get to the drain. All tub drains require this void. Currently, a cardboard box that is filled with dirt is used.

After the cement is poured, the next step in the current practice is for plumbers is to dig out the box that was put over the drain rise and filled with dirt using a shovel or other tool. Then, a pipe must be cut to fit the subfloor in order to connect the waste and overflow of the tub. After the tub is tied to the drain riser, the void or hole created by the dirt and cardboard box must be filled with cement or tar. This is a time consuming and onerous job.

If there were a way in which this process could be improved, be made more efficient, more cost-effective, and easier, proper installation of a bathtub would be easier.

Thus, there is a need for new form tub drain framework aide apparatus configured to facilitate installation of a bathtub during home construction or thereafter.

SUMMARY OF THE PRESENT INVENTION

These, and other objects are achieved by a form for use in installing a bathtub. The form reserves a space in the concrete for pipes, and can be easily removed after the tub has been installed. The tub box embodying the present invention eliminates damage caused by bathtub leaks and is a revolutionary way to do away with voided space in concrete slabs. It elevates the hole that is left in second floor knockouts and facilitates the easy installation of new bathtubs.

In the preferred embodiment of the present invention, a two-inch schedule 40 DWV fitting is used for an outlet, as well as a two inch female hub. Both are connected to a two inch P-Trap. A brass pull tab allows for the tub box to be tested during the inspection stage, and provides an easy hook up for a bathtub. The tub box has a switch that is used as an indicator to a leak. The switch cradle for an overflow screw, as well as a hollow bolt, allows the switch to work easily. There are no longer open holes in cement on multistory floor construction. The present invention reduces damage and fills voids in cement and in flooring. The apparatus of the present invention preferably uses recycled plastic, and does not require packaging, making it environmentally friendly.

Through use of the apparatus of the present invention, the drain is simply installed under cement. The top of the apparatus is installed such that it is level to the finished top of the cement. The T-pull tab disposed at the sub-floor allows plumbing to be tested under hydrostatic test. After test, the top slide tub is moved in place, the drain is hooked up to the hookup drain, and the job is complete. The void that is associated with the prior art, and which required filling, is not longer present when the apparatus of the present invention is used.

Yet a further advantage associated with the apparatus of the present invention occurs in the situation in which a ceiling fan has fallen directly under the tub upstairs due to a leak. With the apparatus of the present invention, the leak will find the drain. Accordingly, there will be no more damage to ceilings, insulation, or carpet by water on the floor under a leak.

BRIEF DESCRIPTION OF THE DRAWINGS

The present invention will be better understood with reference to the appended drawing sheets, wherein.

DETAILED DESCRIPTION OF THE PREFERRED EMBODIMENT

Figure 1:
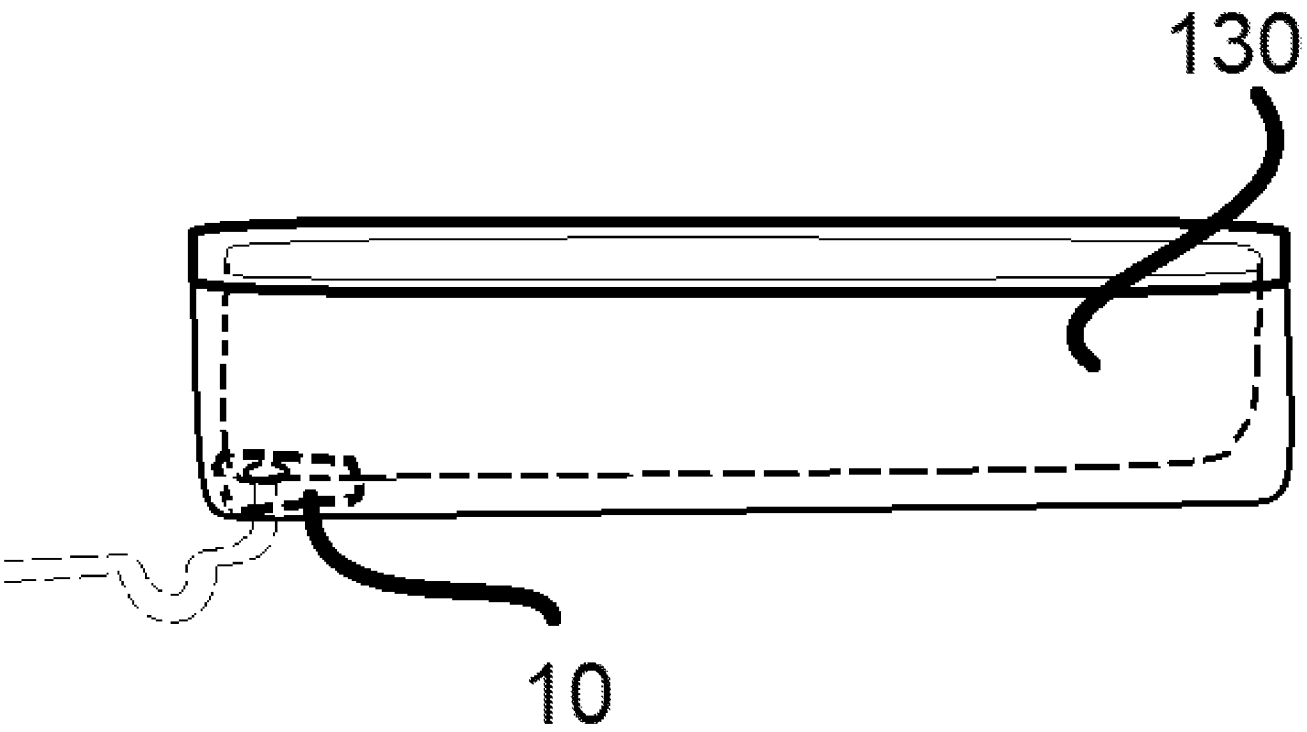
FIG. 1 exhibits a side view of the apparatus of the present invention with a bathtub atop the apparatus.

The present invention is a bathtub installation aid configured to facilitate the placement and ultimate installation of a bathtub, including requisite drainage components.

Referring to the figures, it can be understood that the present invention is embodied in a tub box (10) which includes a body (20) having a bottom (30) which is a bottom surface when the tub is installed, a top (40) which is a top area when the tub is installed (as the tub forms the top of the tub box (10)), a first side wall (50), a second side wall (60), a first end wall (70), and a second end wall (80). The body (20) defines an internal volume (90) which is box shaped. A rim (40) is located around the top perimeter of the tub box (10) and is located co-level with a floor (not shown) when the tub is installed. A top cover (55) is also included, and is removable with respect to the body (20).

Figure 2:
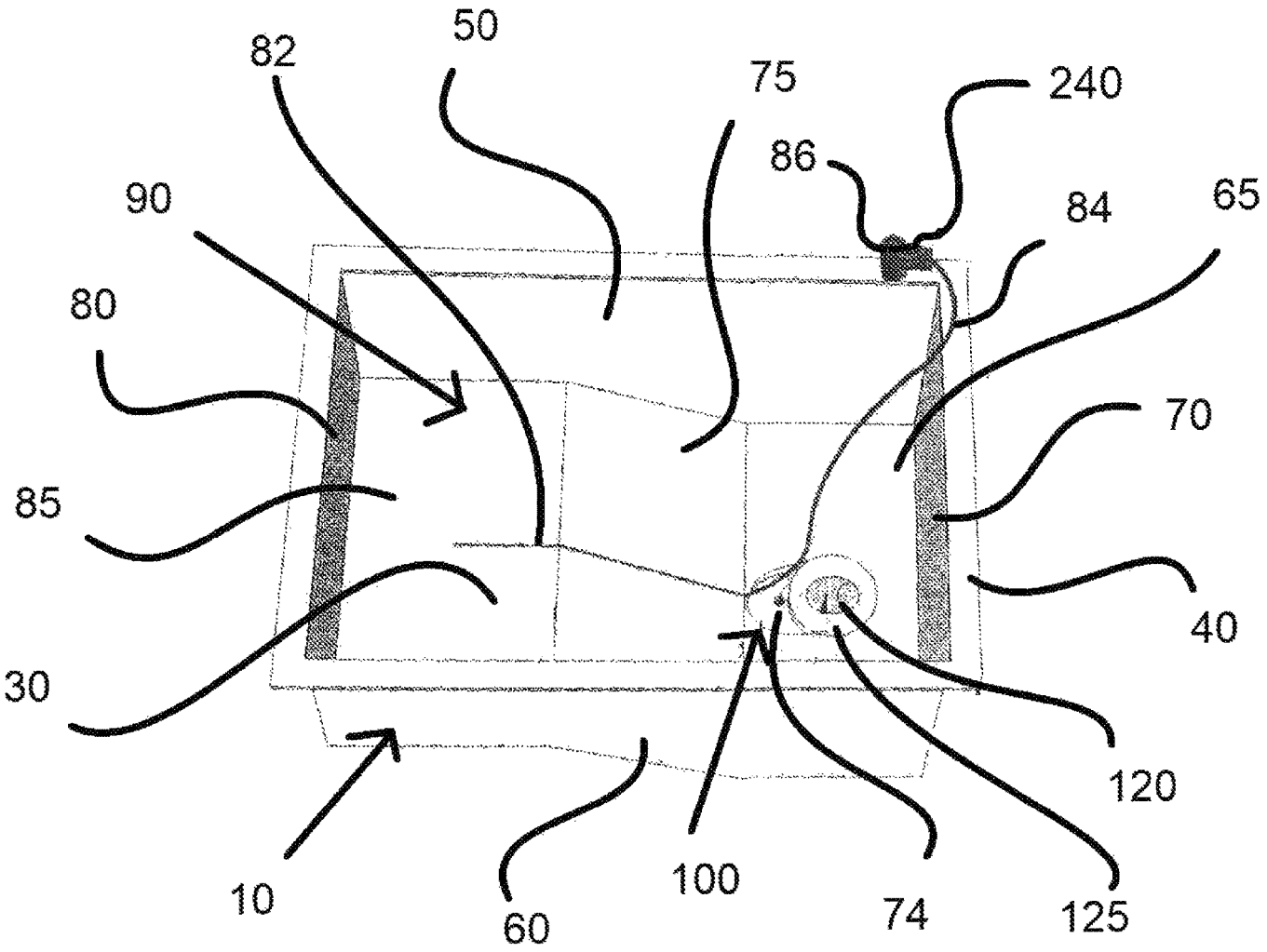
FIG. 2 shows a top and side view of the apparatus of the present invention.

As can be seen in FIG. 2, the bottom (30) is stepped and includes a first step (65), a second step (75), and a third step (85). First step (65) and third step (85) are essentially parallel with the top area (24), and are preferably offset from each other. Second step (75) is angled with respect to these two steps. A drain (100) is located in the first step (65), and the second step (75) acts as a leak trough so that liquid falling into the tub box (10) flows toward the drain.

Drain (100) includes a hub (110) which is fluidically connected to the inside body (20) via an inlet (74) to a drain conduit (not shown). A pull tab (120) overlaps and covers drain inlet (74) during installation and inspection to allow tub (130) to be tested during an inspection stage of the drain.

A leak detector unit (240) includes a sensor (82) located on one end of a connector (84) which has a handle (86) on the other end. Handle (86) includes a grade 8 overflow screw hollow bolt. The leak detector unit (240) may employ an internal battery, or wired directly to insulated AC current, and is configured to relay information to the owner in the event of a detected water leak within the tub box (10), as detected on the third step (85), near the end of the sensor (82). The owner may be notified via his/her mobile device, computer, or a nearby indicator light to indicate the presence of a leak. It should be noted that the leak detector unit (240) only issues an alert relating to a leak to the owner/user when water is detected as present for an extended period of time, such as a time beyond that of a typical shower or bath.

Alternate embodiments of the present invention preferably include a secondary drain configured to drain leaks. In such embodiments, the secondary drain is a twist and lock grid strainer with a bell drain with a backflow device. This allows the tub box (10) to be repaired and replaced as necessary.

Some embodiments additionally include small thread sites, which permit a user to easily secure the top cover (55) to the top of the apparatus of the present invention, and which prevents cement from getting in the box during the pour of the foundation. This also permits removal of the top cover (55) after the pour of cement on top of the tub drain. Holes are located in the corners of the present invention to secure the apparatus in the event that the apparatus ends up in a beam. These holes allow a plumber to install and level the tub box (10) if needed. An element is preferably present to protect the apparatus from being filled with cement. The element amounts to a port between the 1.5 inch drain inside the box, and the two inch drain on the exterior of the bottom (30). The element allows water from a leak to drain into a building sewer. Water flow direction is preferably indicated by an arrow. Element is a one-inch lip that will allow the tub box (10) to rest on a floor once the floor is notched. When the user is ready to hook up the bathtub, the user simply pops the top (125) (via the pull tab (120)) disposed over the drain inlet (74) (present to prevent concrete, bugs, dust, etc. from entering) of the tub box (10), takes a measurement, and installs the drain to the drain inlet (74). There is no need for caulking or sealing, which may leave room for insects to enter the premises or smoke in the event of a fire. A void is defined between the primary and the secondary drain, where water flows into the drain.

INDUSTRIAL APPLICABILITY

Using the device embodying the invention, the current method of installation of bathtubs is greatly improved over the installation as previously described in connection with the prior art. The tub box described herein allows a single worker to install it to the drain under the cement. The tub box of the present invention is installed with the box level to the finished top of the cement. The T-shaped pull tab disposed at the subfloor allows the plumbing to be tested under the hydrostatic test. After the test, the worker merely pops the top (125) via the pull tab (120), slides the tub into position, and hooks up the drain. The void that had to be filled in via the process of the prior art is no longer present in the process of use of the present invention. This results in the elimination of dirt having to be placed within a cardboard tub box, or the need for a plastic tub with a hole drilled in it.

As discussed above, another example in which the use of the tub box of the present invention is useful is when a ceiling has fallen directly underneath a bathtub on an upper floor as a result of a leak. As also previously discussed, with the apparatus of the present invention, the leak will find the drain, eliminating damage to ceilings, sheetrock, insulation, or carpet, which could otherwise become damaged as a result of water on the floor underneath the leak. The leak trough of the present invention allows the bathtub leak to go into the drain as intended, rather than into the ceiling. This saves money on maintenance and repair costs for the end user.

Preferred Form

Figure 3:
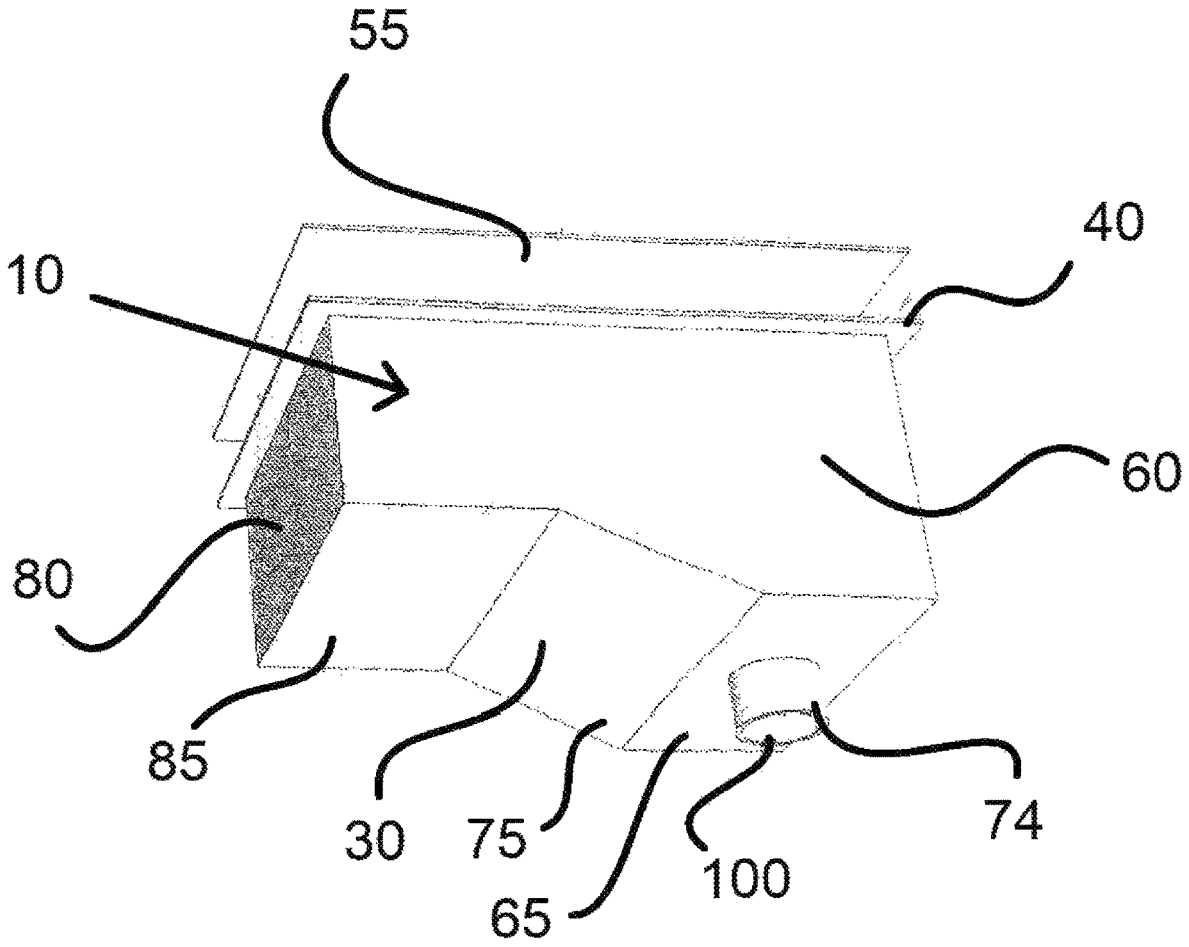
FIG. 3 depicts a side view of a primary embodiment of the present invention in use on a tub.

The preferred embodiment of the tub box of the present invention is preferably made using recycled schedule 40 PVC plastic as shown in FIG. 2 and FIG. 3. The preferred embodiment is preferably 12 inches long, nine inches wide, and has a depth of two and ½ to four and ½. The apparatus is equipped with a leak trough, a one and ½ Drain Waste Vent (DWV) fitting for the waste overflow connection, a two-inch schedule 40 DWV fitting for an outlet that has an inside diameter of one and ½ inches, and a brass pull tab. It should be understood that the present invention is preferably reinforced in order to support the weight of a bathtub and occupants.

It should also be understood that the apparatus of the present invention is preferably available in multiple sizes in order to accommodate differing tub designs and sizes (such as jacuzzi tubs, hot tubs, garden tubs, and specialty tubs). In general, all tub drains are the same, but are located in different locations. In all embodiments, the present invention is configured to rest below the over flow location as well as to accommodate the drain location of the installation. In installations with non-standard drain sizes, an adapter may be employed to facilitate connection of the present invention to the tub drain.

Figure 4:
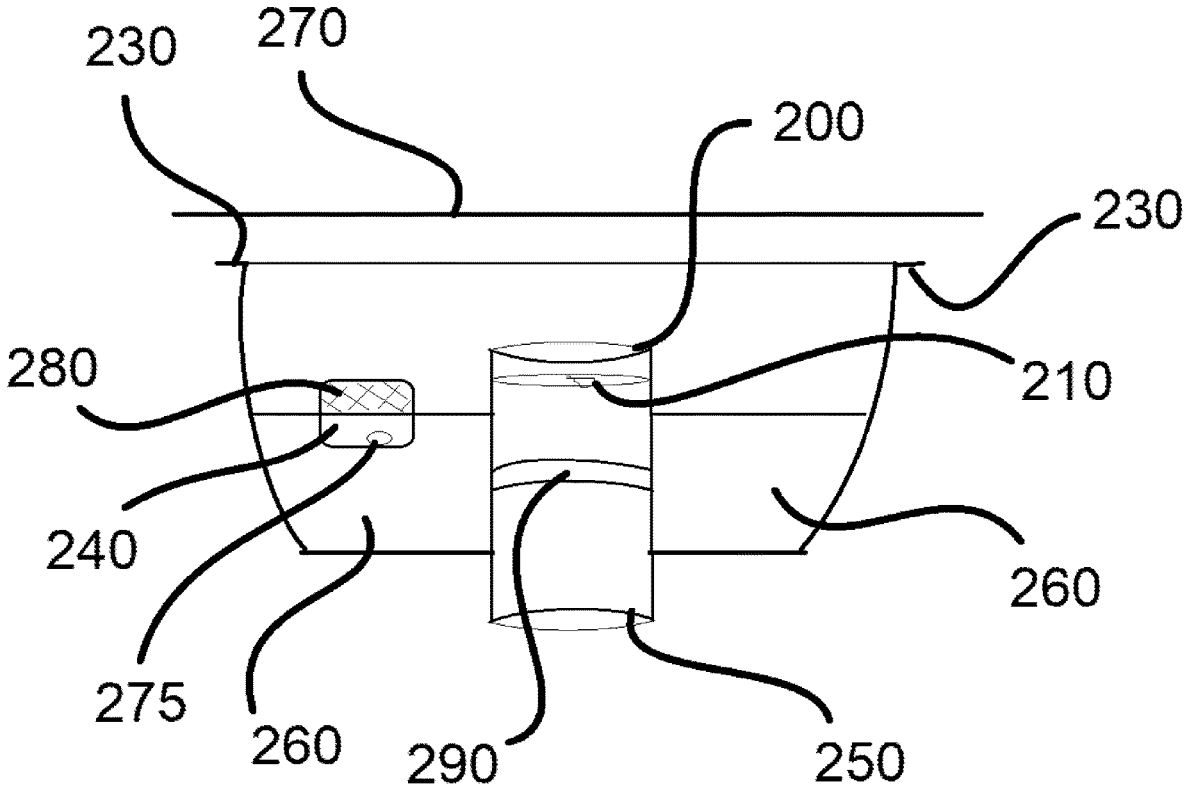
FIG. 4 depicts a side profile view of an alternate embodiment of the present invention configured for use to facilitate installation of a shower trough.

Some alternate embodiments of the present invention may be configured for use in the installation of shower stalls to similarly expedite the installation process of such showers. As shown in FIG. 4, an embodiment configured for use beneath a shower trough installation is similar to the primary embodiment in that it is equipped with a first two-inch female slip PVC pipe (200) to facilitate drain connection, a pull tab (210), an outer lip (230) configured to rest the apparatus on the floor, a leak detector (240), a second two-inch slip PVC pipe (250) for connection to the building sewer, and void (260) for water leak collection. The leak detector unit (240) is equipped with a back-flow preventer (280) which is a twist-and-lock preventer, as well as a secondary drain (275) for leaks. A top (270) composed of a light-duty plastic is also present and available during installation. A gap (290) may be present between the first two-inch female slip PVC pipe (200) and the second two-inch slip PVC pipe (250) to allow water to enter the building sewer from within the housing.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A bathtub installation aide and leak detection apparatus for use in the installation of a conventional bathtub having a drain, hub, and body comprising:

a housing, said housing is box-shaped having six sides including a top side and a bottom side, said bottom side having three platforms exhibiting different planes, said top side generally planar, configured to circumscribe the drain and immediate surrounding area of the drain of the bathtub;

wherein the top side is removable;

a drain input, said drain input disposed on said bottom side;

wherein said drain input is configured to interface with a drain of the bathtub;

wherein said drain input is disposed directly beneath the drain of the bathtub;

wherein said housing is non-permeable to poured concrete; and wherein said housing is reinforced to withstand weight of the bathtub.

2. The apparatus of claim 1, wherein said housing is disposed beneath the bathtub drain and an overflow of the bathtub.

3. The apparatus of claim 1, further comprising:

a first step, said first step is level and includes said drain input;

a second step, said second step angled up and away from said first step at a first angle; and a third step, said third step connected to said second step, said third step having a second angle up and away from said second step, the second angle being more acute than said first angle.

4. The apparatus of claim 1, further comprising:

a leak detector unit, said leak detector unit equipped with at least one sensor configured to detect the presence of water;

wherein said at least one sensor conveys information to the leak detector unit via a connector; and wherein said leak detector unit is configured to indicate the presence of a leak when said at least one sensor detects the presence of water for an extended period of time.

5. The apparatus of claim 3, further comprising:

a leak detector unit, said leak detector unit equipped with at least one sensor configured to detect the presence of water;

wherein said at least one sensor conveys information to the leak detector unit via a connector; and wherein said leak detector unit is configured to indicate the presence of a leak when said at least one sensor detects the presence of water for an extended period of time.

* * * * *